US006308489B1

(12) United States Patent
Romes

(10) Patent No.: US 6,308,489 B1
(45) Date of Patent: Oct. 30, 2001

(54) ROLLED FABRIC DISPENSING APPARATUS

(75) Inventor: Gary E. Romes, Cincinnati, OH (US)

(73) Assignee: Guardian Fiberglass, Inc., Albion, MI (US)

( * ) Notice: Subject to any disclaimer, the term of this patent is extended or adjusted under 35 U.S.C. 154(b) by 0 days.

(21) Appl. No.: 09/511,305

(22) Filed: Feb. 23, 2000

(51) Int. Cl.[7] ..... E04B 1/00; E04G 21/00; E04G 23/00

(52) U.S. Cl. ..... 52/742.12; 52/746.11

(58) Field of Search ..... 52/742.12, 746.11

(56) References Cited

U.S. PATENT DOCUMENTS 3,698,972 * 10/1972 Lenzner ..... 52/742.12
4,869,044 * 9/1989 Wald ..... 52/746
6,195,958 * 3/2001 Neifer et al. ..... 52/746

* cited by examiner

*Primary Examiner*—Carl D. Friedman
*Assistant Examiner*—Chi Q. Nguyen
(74) *Attorney, Agent, or Firm*—Hall, Priddy, Myers & Vande Sande

(57) ABSTRACT

Apparatus for installing rolled fabric as a vapor retarder in an insulated building structure which includes a frame member and a purlin contact which firmly biases the roll of fabric against the structural members on which the fabric is being laid but which is of a construction so as to avoid abutment with building cross members that would normally interfere with the dispensing operation.

13 Claims, 6 Drawing Sheets

ROLLED FABRIC DISPENSING APPARATUS

FIELD OF THE INVENTION

This invention relates to apparatus for dispensing a rolled fabric. More particularly, this invention relates to apparatus for dispensing a rolled fabric across the width of at least two longitudinal structural supports.

BACKGROUND OF THE INVENTION

Metal roof structures are typically comprised of a series of rafters which extend parallel to each other from each side of a building to its roof peak. Longitudinal structural supports (eg. purlins or bar joists) are typically mounted on top of and perpendicular to these rafters in a similarly parallel fashion. In like fashion, the walls of a building may be comprised of a series of vertical studs or columns on which purlins/girts are mounted in a horizontal fashion (perpendicular to the studs or columns). It is noted that purlins, when installed on such a wall structure, are usually referred to as girts. Therefore, for the purposes of this application, the terms purlins and girts may be used interchangeably.

In one manner of constructing such a known metal roof structure (or wall structure) as described, a fabric (eg. polyethylene) is first rolled in sheets over these purlins/girts. These sheets then serve as a vapor barrier for the metal roof structure (or wall structure).

Once the insulation is installed over the sheet of fabric, the insulation is secured in place with hard (typically metal) roof (or wall) sheeting attached to the upper surface or flange of the purlins.

Heretofore, it has been known in the art to install fabric across the top of purlins by hand or by various carriage devices such as illustrated in U.S. Pat. No. 5,495,698. Installation by hand is often quite time consuming and labor intensive and gives rise to certain safety problems particularly during unusual weather conditions such as high winds. Federal and state OSHA regulations have been passed to enhance safety in this regard through the mandated use of fall protection devices. Installation can also be expensive when it requires extensive pre-preparation (i.e. machine setup) because of the large size of certain known devices used to install the rolled fabric. Further, these known devices are often difficult to install, are designed to operate only in one direction along the length of a purlin, or must be detached and reattached through a cumbersome process when the tensioning device (which biases the roofing fabric roll against the purlin) reaches a purlin cross support.

In view of the above, it is apparent that there exists a need in the art for a rolled fabric dispensing apparatus which overcomes the above drawbacks. It is a purpose of this invention to fulfill this need in the art, as well as other needs which will become apparent to the skilled artisan once given the following disclosure.

SUMMARY OF THE INVENTION

Generally speaking, this invention fulfills the above needs in the art by providing in a rolled fabric dispensing device for applying a sheet of fabric from a roll of fabric across a building structure comprised of at least one pair of two spaced, longitudinally extending substantially parallel structural members at least one of said members being comprised of a first edge and a second edge separated by a web portion, the second edge of at least one of the members having connected thereto a longitudinal flange member extending laterally from the second edge, the flange comprising a first surface and a second surface to which the sheet is applied, the building structure further including at least one laterally extending cross member connected at one end to the web portion of one of the two longitudinal structural members and at the other end to the web portion of the other of the two longitudinal structural members and so located with respect to the first surface of the flange member so as to define a glide space between the cross member and the flange member;

the rolled fabric dispensing device comprising a frame member for contacting the second surface of the flange member, a rolled fabric retention member attached to the frame member for rotatably retaining the fabric roll in contact with the second surface of the flange member and a glide member attached to the frame member and engageable with the first surface of the flange member, the improvement comprising:

wherein the glide member is so constructed as to be of a size and profile which allows the glide member to be unobstructed by said cross member while said glide member is in contact with the first surface of the flange member and is moved through the glide space and the sheet of fabric is dispensed by the device and applied to the second surface of the flange member.

In one embodiment of this invention the glide member includes a glide plate which is connected to the frame member by a mechanism which biases the glide plate against the first surface of the flange member whose second surface is receiving the sheet of fabric during the dispensing operation.

In yet another embodiment of this invention, the biasing mechanism is locatable within the device so as to allow the glide plate to be biased against the first surface of the flange member regardless of which direction, right or left with respect to the dispensing direction, the flange extends from the web portion of the structural member. In this respect the biasing mechanism is so designed that its relevant parts are easily removable and reassembled on the job site to enable the installer to quickly adjust in order to accommodate a right or left extending flange member.

The invention will now be described with respect to certain embodiments thereof as set forth in the accompanying illustrations, wherein:

IN THE DRAWINGS

DETAILED DESCRIPTION OF CERTAIN EMBODIMENTS

Figure 1:
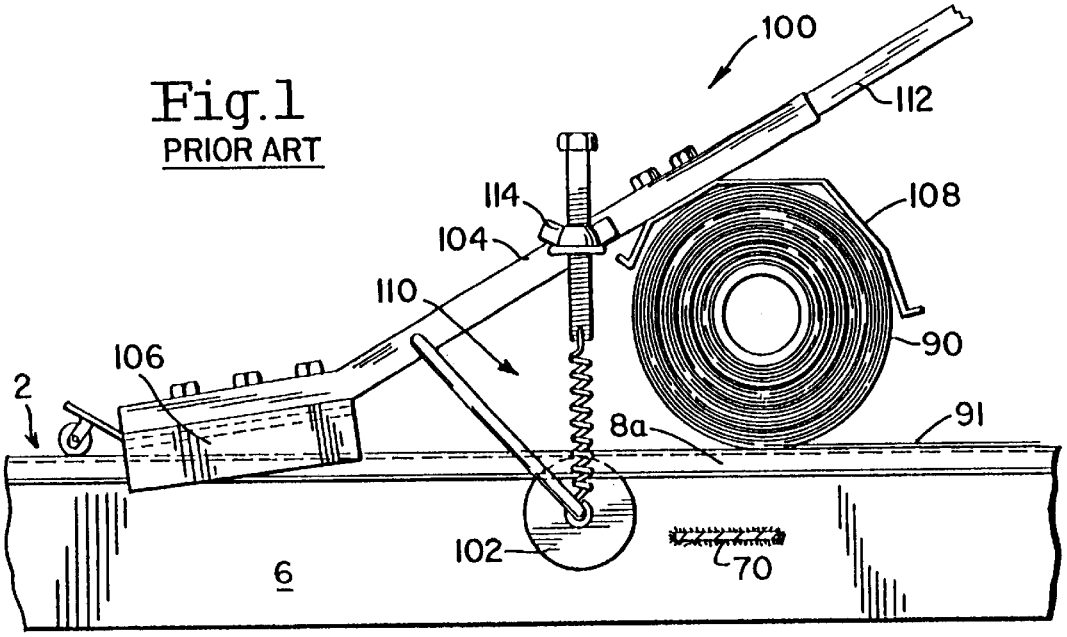
Fig.1 PRIOR ART
FIG. 1 is a side plan view illustrating a known rolled fabric dispenser in the prior art.

This invention constitutes an improvement upon the dispenser shown in FIG. 1, a device more fully described in commonly owned U.S. patent application Ser. No. 09/392,716 filed Sep. 9, 1999 and entitled ROOF FABRIC DISPENSING SYSTEM, now U.S. Pat. No. 6,247,288.

Figure 2:
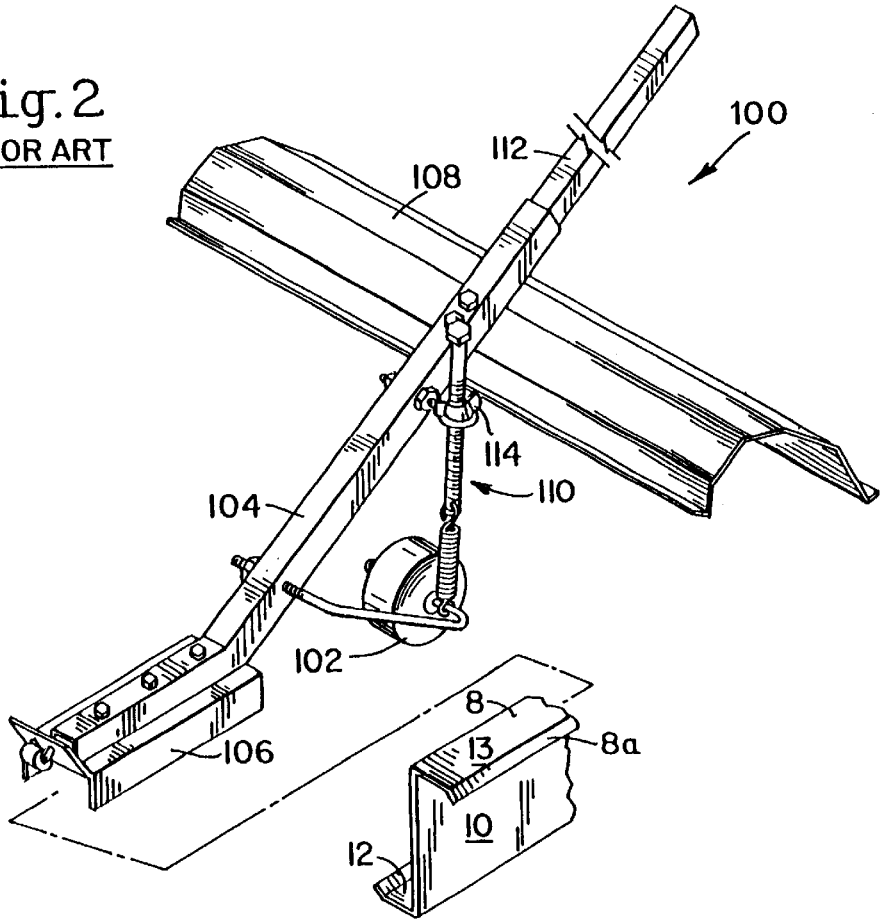
Fig.2 PRIOR ART
FIG. 2 is a three-dimensional view of the prior art dispenser illustrated in FIG. 1.

FIGS. 1 and 2 (prior art) illustrate a known and rather successfully used, commercial dispenser 100 for applying a roll of fabric 90, such as high-density, woven- polyethylene, over purlins in a roof system. Generally speaking, commercial dispenser 100 includes a frame member 104, a guide 106 for embracing the top flange of a purlin (or girt) 6 with a minimum amount of friction, a fabric roll retaining means 108 for retaining a roll of fabric 90 against the surface of the flanges of purlins 6. Provided as a means for biasing the roll against the purlin flanges onto which the sheet 91 of fabric is applied (with or without adhesive or adhesive tape first being applied) is a tensioning device 110. Through its biasing spring, adjustable by wing nut 114, the entire device 100 is secured to the upper surface of the purlin flange via a glide roller 102, upwardly biased by the coil spring against the undersurface of the flange. For convenience, only purlin 6 and cross support member 70 are shown in FIG. 1.

Figure 3:
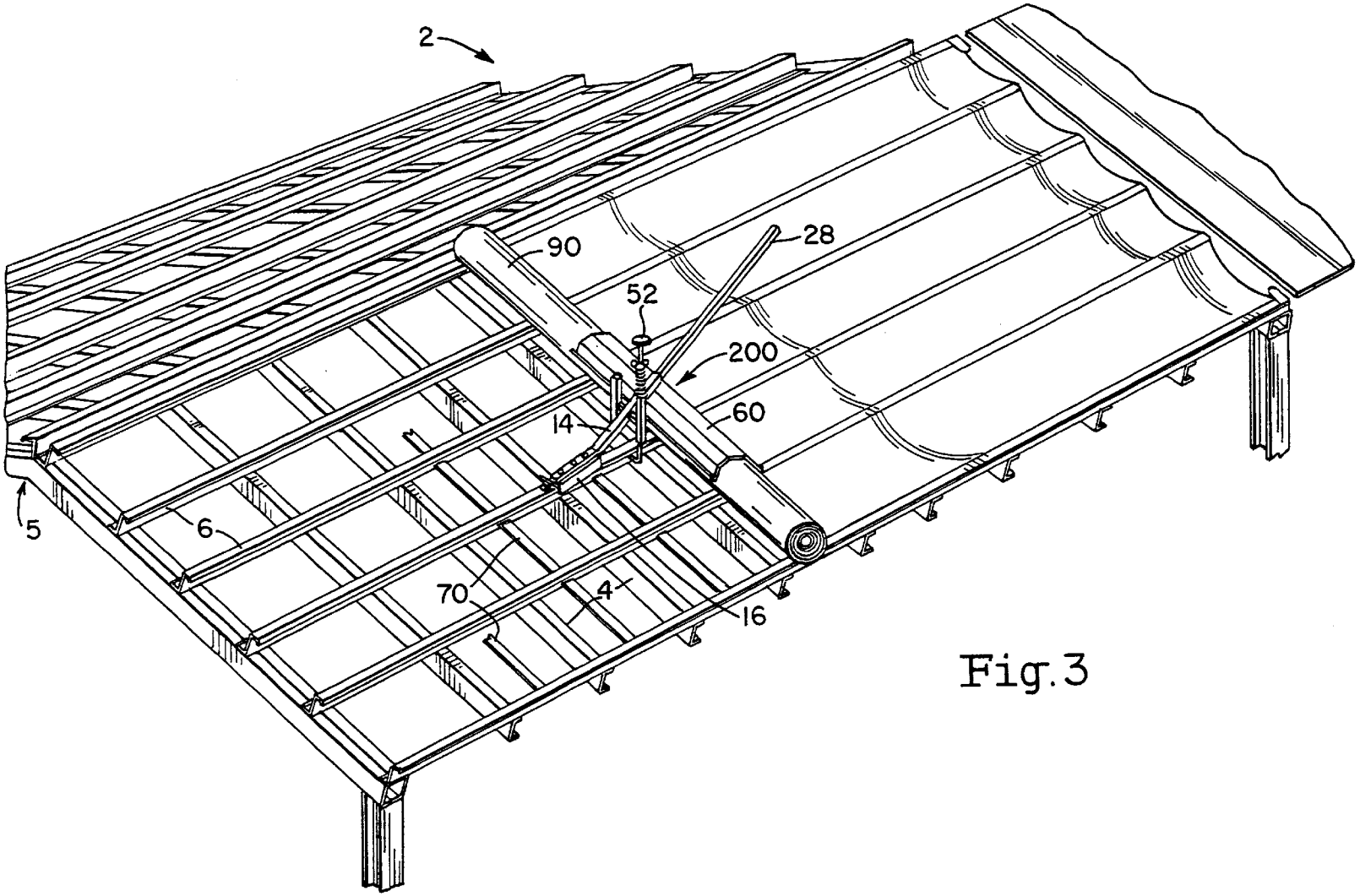
FIG. 3 is a partial, three-dimensional view of a rolled fabric dispenser according to one embodiment of this invention in its dispensing mode on the roof of a typical metal building structure.

As better illustrated in FIG. 3, the typical roof structure 2 experienced in practice, normally includes a plurality of parallel purlins 6, as well as cross support members 70. Purlins 6 are conventionally "z" shaped in cross section (see FIG. 4) and include a vertical web portion 10, which connects a top flange 8 to a lower flange 12 each of which extends perpendicularly from web portion 10. As shown in phantom section (dotted lines) in FIG. 4, purlins 6 may be installed in the roof structure so as to have their top flanges 8 (for example) oriented in the same or opposite directions.

When prior art dispenser 100 is employed, and the dispenser is mounted in place on a purlin 6 to dispense fabric 90, such as is illustrated in FIG. 1, tensioning device 110 biases glide wheel 102 against the under surface of top horizontal flange 8. In turn, this biasing force serves to hold guide 106 and a roll of fabric 90 (via engagement means 108) firmly against the upper surface of top horizontal flange 8. In order to dispense the roll of fabric into a sheet 91 extending across the purlins by residing on top of the flanges 8, push pole 112, shown inserted in frame 104, may be used to propel the dispenser 100 along the length of purlin 6, thereby unrolling fabric 90 onto the upper surface of the roof structure 2 (top flange 8).

Referring again to FIG. 3 there is illustrated a typical metal roof structure, generally indicated at 2. This figure helps demonstrate the problems with dispenser 100 when faced with such a popular roof structure and further serves to highlight the improvements of the invention herein. Generally speaking, roof structure 2, as illustrated, includes rafters 4 which are fixed in a parallel arrangement and extend from one side of the roofing structure 2 to the roof peak as indicated at 5. In practice, rafters 4 may be spaced as shown or, at other times, more widely spaced. Typically such spacing is approximately 25 feet centerline to centerline with respect to these rafters 4. Purlins 6 (or in other embodiments, bar joists) are fixedly attached via their lower horizontal flange 12, to, and on top of, rafters 4 in a perpendicular configuration. They are normally spaced at a distance of five feet (centerline to centerline) in a substantially parallel fashion. At times, of course, other spacing is employed. In addition, the top horizontal flanges 8 of the purlins 6 do not always extend in the same direction. In some cases, for example, purlins 6 may be installed with the top horizontal flanges 8 extending both towards and away from the roof peak 5 (e.g. both right and left in relation to the forward direction the dispenser takes when dispensing the fabric). Cross support members (i.e. bracing members) 70 are provided and are attached to adjacent vertical web portions 10 of purlins 6 (spanning the distance between two parallel purlins) to provide additional strength to the roofing structure 2.

The use of cross support members 70 presents the problem referred to above, which is associated with dispenser 100 and which is overcome by dispenser 200 of this invention. As shown best in FIG. 1, wheel 102 of prior art dispenser 100 comes into interfering, obstructing, contact with cross support member 70 during the dispensing process. This necessitates the disengagement of dispenser 100 each time a cross support member 70 is reached. The magnitude of this problem is heightened by the generally time consuming and cumbersome fashion of the disengagement process. As can be seen, each time the dispenser 100 is to be mounted or removed to or from a purlin, wing nut 114 must be adjusted (i.e. threaded upwardly) a sufficient distance to allow the large glide wheel 102 to be removed from under flange 8, including its lip 8*a*, and then readjusted after clearing the cross member, to the proper tension, each time a cross member obstructs the path of the dispenser. Moreover, as another problem, each time a purlin flange extends in a different direction, the device must be started in a different direction or another device having the glide member on the other side of frame member 104 put into service.

Figure 9:
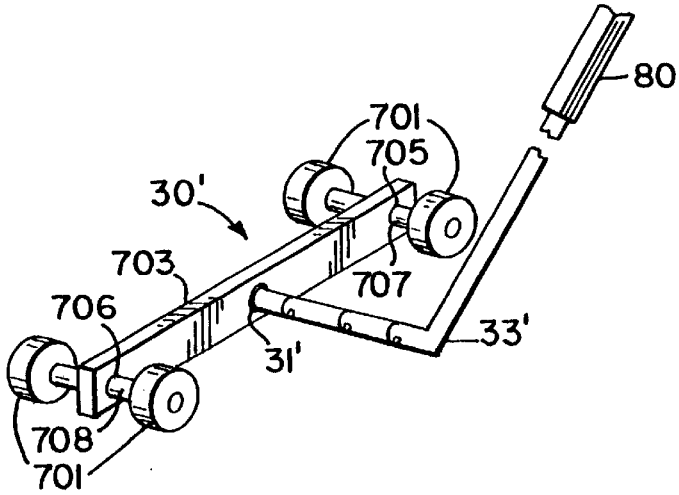
FIG. 9 is a partial perspective view of an alternative low profile glide mechanism according to this invention.

Both of these problems are solved by the subject invention through the use of unique mechanisms which will be described in greater detail in the paragraphs that follow. Generally speaking however, and with particular reference to FIGS. 3–6, a unique mechanism is provided, which renders dispenser 200 capable of dispensing along the full length of a purlin 6 without the need for removal upon encountering a cross support member 70. As can be seen dispenser 200 includes a low profile glide plate 30 attached to a biasing mechanism generally shown at 40, which affords the significant advantage of (1) being of a sufficient size and construction so as to easily clear the distance "X" (see FIG. 5) between the lower surface 9 of flange 8 and the upper surface 11 of cross member 70, and (2) having the unique ability to permit the dispenser 200 to be quickly attached and detached from the purlins 6 without need for any readjustment as described more fully below. FIG. 9 illustrates an alternative low profile glide mechanism 30' wherein wheels 701 and frame member 703 are likewise of a small enough dimension to easily clear distance "x".

As stated above, a second problem associated with prior art dispenser 100 is its inability to easily adapt to a change in the orientation (direction) of top horizontal flanges 8. As aforesaid, during construction of a metal roof structure 2 (or wall structure), purlins 6 are not always installed across the rafters 4 in a uniform orientation. Therefore, the top horizontal flanges 8 of the various purlins 6 may be oriented in both a right and left extending manner with respect to the direction of dispensing. In the illustrated prior art dispenser as shown in FIG. 2, wheel 102 and tensioning device 110 are attached to frame 104 at a right offset by bolts such that the illustrated dispenser 100 may only dispense along a purlin 6 which contains a similarly extending top flange 8 (from vertical web portion 10) unless, for each different flange extension direction, wheel 102 and tensioning device 110 are unbolted, rebolted and the tension properly readjusted on the other side of frame 104. The alternative requires having available for use on the job site a second dispenser 100 for use on purlins having an opposite extending top horizontal flange 8. Even here time is lost in remounting a new device and properly adjusting its tension. In addition, even if all purlins 6 are installed with the top flanges 8 oriented in a single direction, the installer is inhibited in his choice of which end of the roof (or wall) to begin dispensing from, unless the installer has at his disposal two dispensers 100, each designed for a different top flange 8 orientation (or is willing to unbolt, rebolt, and readjust tensioning device 110).

The subject invention solves this second problem by way of a unique structure (FIGS. 3–5) which employs two hollow tubular arms 80 and 82, into which biasing mechanism 40 may be quickly and easily (in the alternative) inserted thereby enabling the same dispenser 200 to dispense along a purlin 6 regardless of the orientation of its top horizontal flange 8, the ease with which this may be done as described more fully below.

Figure 4:
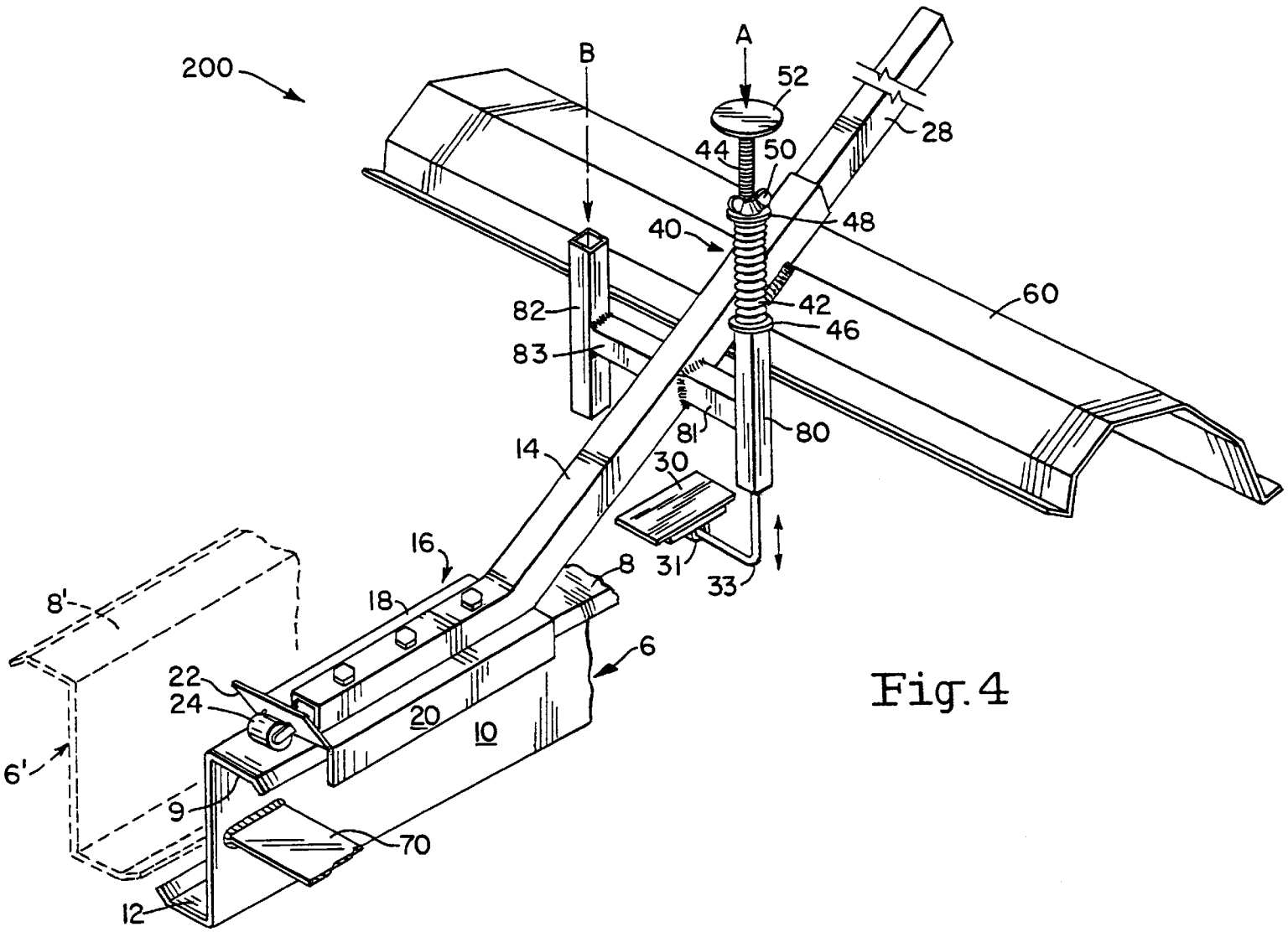
FIG. 4 is a three-dimensional view of the rolled fabric dispensing device illustrated in FIG. 3.
Figures 5, 6:
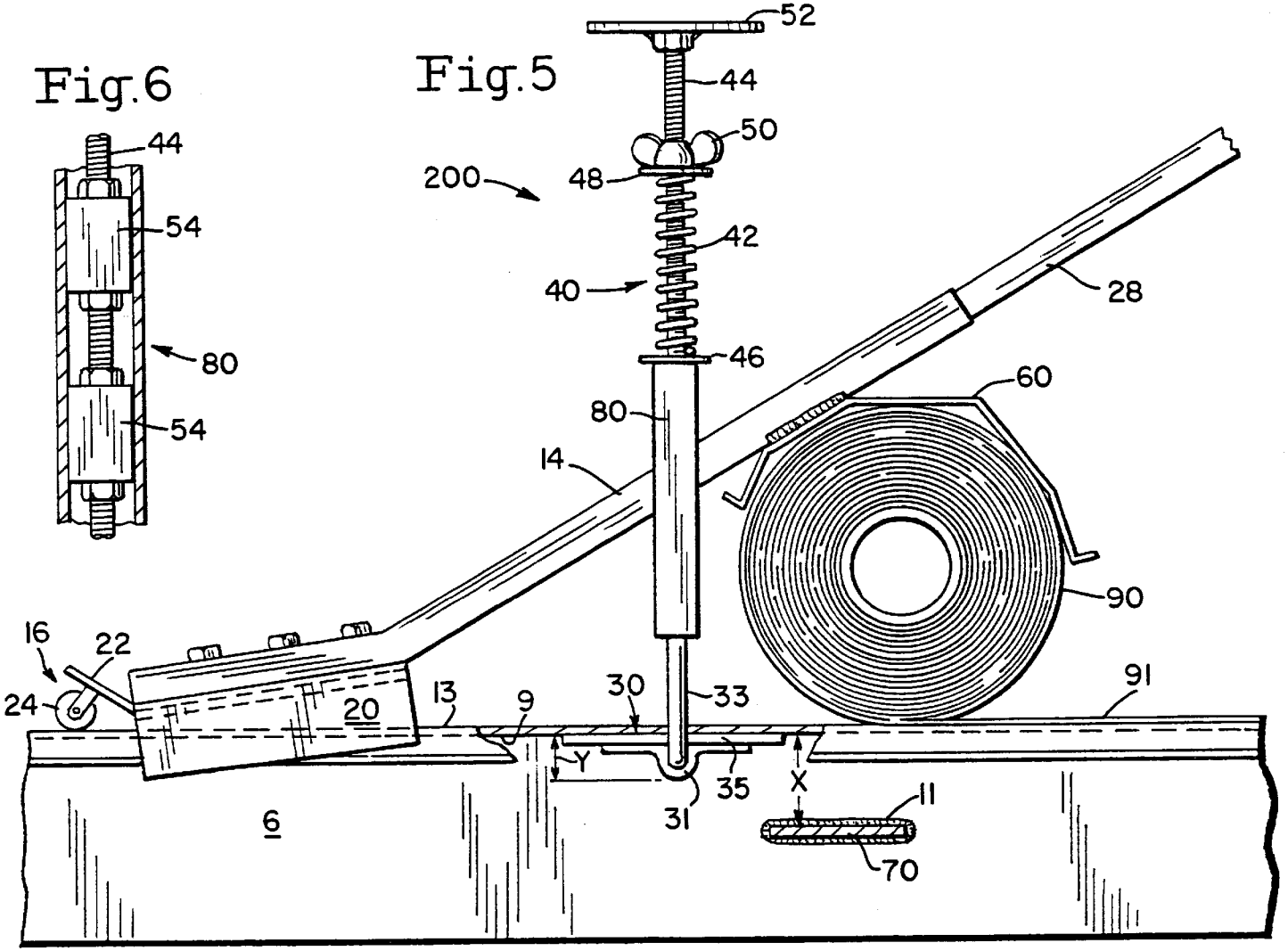
FIG. 5 is a side plan view of the rolled fabric dispensing device illustrated in FIG. 4 in combination with rolled fabric to be dispensed on the purlins of a building structure.
FIG. 6 is a partial side section view of the tube and rod assembly of FIG. 5.
Figure 8:
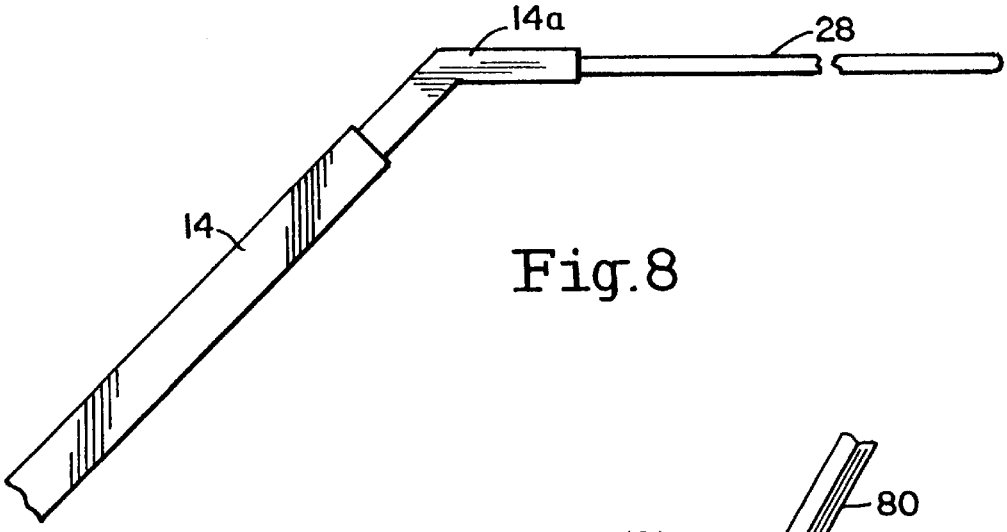
FIG. 8 is a partial side plan view of an optional extension device constituting a part of an embodiment of this invention.

Referencing now an embodiment of the improved rolled fabric dispensers of this invention, namely dispenser 200, as shown in FIGS. 3–5, rolled fabric dispenser 200 includes a frame member 14, a guide member 16 having a general box like profile to guide it when sliding along on purlins 6 principally on front roller 24. Dispenser 200 further includes (retention) member 60 for retaining a roll of fabric 90 securely in place against the surface of purlins 6. Member 60 is basically circular in shape, so as to allow fabric roll 90 to freely rotate therein so as to evenly dispense roll 90 into sheet form 91. Further included is a biasing mechanism 40 which works to normally bias a glide plate 30 against the under-surface 9 of purlin top horizontal flange 8 and, via frame member 14 connected to retention member 60, to normally bias roll 90 (and thus the initial portion of sheet 91) against upper surface 13 of flange 8. Additionally, and optionally provided, is extension push pole 28, which is inserted into an end of frame member 14, and may be generally used as a means for facilitating pushing dispenser 200 along the length of purlins 6. In an alternative embodiment shown in FIG. 8, push pole 28 is supplemented by an angular insert 14*a*, inserted between member 14 and push pole 28. The pushing motion is facilitated, and dispensing is made more uniform by making insert 14*a* of an angle such that pole 28 extends substantially parallel to purlins 6. A height equal to about the waist of the installer for push pole 28 is optimal.

Dispenser 200 further includes a unique, low profile glide mechanism 30 rotatably attached at pivot orifice 31 to one end of biasing mechanism 40 via shaft 33. Two alternative embodiments are shown. FIG. 4 illustrates slide plate glide mechanism 30 while FIG. 9 illustrates a roller type glide mechanism 30'.

With reference first to the embodiment of FIG. 4, glide plate 30 is attached to biasing mechanism 40 via bent shaft 33, which extends outwardly beyond the confines of flange 8. While shaft 33 need not be rotatable in orifice 31, it is preferred that it be so attached in order that the upper surface of guide plate 30 remain flush for easy sliding along surface 9 of flange 8, regardless of changes in the angle of shaft 33 with respect to surface 9 that may be encountered during fabric dispensing. Shaft 33 may be part of a single continuous rod 44 or journaled thereto by conventional threaded attaching means (not shown). In either instance, glide plate 30 is capable of fully engaging the under-surface 9 of purlin top horizontal flange 8 (or a bar joist in an alternative embodiment). In view of the nature of biasing spring 42 described below, plate 30 holds firmly against purlins 6, which allows roll 90 to rotate, so as to evenly dispense sheet 91. This is particularly important in high winds when fabric 90 has a tendency to act as a sail and force roll 90 or rolled fabric dispenser 200 out of dispensing position.

For ease of sliding, the upper surface of plate 30 may be provided with a low friction surface 35, such as Teflon® or nylon. As can be seen, particularly with respect to FIG. 5, the entire side plan profile dimension "y" of plate 30 (including low friction surface 35 and shaft orifice 31) is significantly less than distance "x" thus insuring that a cross member 70 will never obstruct the dispensing operation as experienced in the aforesaid prior art operation.

In an alternative embodiment, glide mechanism 30 may be of any low profile design and of any material which is low-friction so as to enable it to easily slide (or roll) along the under-surface 9 of top horizontal flange 8. For example, a wheel may be used as the glide member 30 as long as its diameter is less than distance "x" (herein defined as the "glide space"). Another embodiment, in this respect, is illustrated in FIG. 9 wherein items 31, 33, etc. remain as described above, with shaft 33' preferably being rotatable in orifice 31' formed in longitudinal base member 703. At either end of base member 703 there are drilled holes 705, 706, respectively, which retain pin axles 707, 708 having at their ends wheels 701. In this embodiment, of course, shaft 33' is again offset so as to extend beyond a purlin's upper flange. Moreover, the length of the axle/wheels is such as to fit within the underside, and roll or slide along that underside surface of the top flange of the purlin to which it is attached. The mechanism 30', of course, maintains its low profile with wheels 701 being the determining factor. In one embodiment, for example, member 703 may have a length of about five inches with wheels having a diameter of about one inch and a wheel to wheel (outside dimension) width of about 2-½–3 inches. Wheels 701 may be made of a rollable or slidable material such as Teflon® or nylon.

Dispenser 200 is further provided, as above stated, with a unique biasing mechanism 40 for effectively overcoming the aforesaid drawbacks of prior art device 100. Mechanism 40 includes push plate 52, attached to threaded rod 44 and used to compress coil spring 42 thereby when depressed, releasing the biasing force of glide mechanism 30 against purlin 6. More specifically, biasing mechanism 40 comprises coil spring 42, with threaded rod 44 inserted therethrough. Extending from either side (or preferably both sides) of frame member 14 are hollow tubes 80, 82 (round or square) through which rod 44 extends. Which tube 80 or 82 is employed depends, of course, on which side of web 10 flange 8 extends. The top of tube 80 or 82 provides a lower support, preferably via washer 46, for coil spring 42. An upper stop against expansion of coil spring 42 is provided by wing nut 50, preferably with washer 48 located beneath it, through which rod 44 is threaded. By threadily rotating nut 50 on rod 44, coil spring's is biasing force can be adjusted through more or less compression of the spring.

In order to enable rod 44 to be moved through tube 80 or 82 more easily, teflon blocks 54 (shown in FIG. 6) may be optionally employed. Blocks 54 are shaped to conform to the space within tubular arms 80 and 82 and are fixedly attached to rod 44. Blocks 54, when tubes 80 and 82 are square in cross-section, serve to prevent rod 44 from rotating within arms 80 and 82. Blocks 54 may, of course, be of any material or shape sufficient to prevent rod 44 rotation as within arms 80 or 82. Teflon® or other material (e.g. nylon) is preferred, as is a square or rectangular cross section as shown.

Located at the uppermost end of rod 44 is push (palm) plate 52 which is removably attached to rod 44 via a threaded opening for receipt of the complimentarily threaded upper end of rod 44. As can be seen, by merely manually depressing palm plate 52, spring 42 is compressed and via shaft 33, glide plate 31 is separated from purlin 6. By providing a rod 44 of appropriate length as well as an appropriately designed coil spring 42 and an appropriate length of vertical section of shaft 33, the entire dispenser 200 may be easily removed from or assembled onto purlin 6 without need for disassembly. By again manually depressing palm plate 52, the dispenser 200 may then be easily installed or reinstalled for use on a purlin 6. Wing nut 50 is then employed (adjusted) to create the applicable biasing force in spring 42 necessary to ensure contact of glide mechanism 30 with purlin 6 during operation and to provide the desired degree of tension in fabric sheet 91 across the purlins.

Referring now, in particular, to FIG. 5, a significant advantage of this invention is the capability of a single dispenser 200 to install fabric 90, in sheet form, across an entire structure, regardless of whether it is confronted on a job site with either a right or left extending purlin top flange 8 (or both right and left extending flanges on the same job). This feature is accomplished by providing dual offset tubular arm structures 80 and 82 through which biasing mechanism 40 may be alternately assembled to accommodate different flange orientations. In this way, a single dispenser 200 is able to install rolled fabric regardless of the orientation of top flange 8 encountered on the purlins. More particularly, rolled fabric dispenser 200 provides two tube arms 80 and 82, which are mounted at an offset distance on each side of frame member 14. The distance that arms 80 and 82 are offset is, of course, dependent on the length of the angled lower portion of shaft 33 to which glide plate 30 is rotatably attached. In particular, the respective length and offset should be appropriate such that glide mechanism 30 is in alignment with the under surface of top horizontal flange 8 during operation. Since purlin dimensions are normally standard, rod 44 and shaft extension 33 may be designed accordingly to meet the limited number of purlin dimensions found in commerce.

Generally speaking then, the two tubes 80 and 82 are provided so that biasing mechanism 40 may be easily assembled or switched to alternate sides of frame member 14 depending on the orientation of purlin top flange 8 encountered. For example, in order to achieve the desirable ability to choose on the job site which direction (or end of the roof or wall) is best for dispensing, the contractor on the job site, using this invention, can merely unscrew push plate 52 and wing nut 50 if located on the "wrong" side of the dispenser, and thereafter, biasing mechanism 40 may be easily removed and reassembled in the "proper" alternate tubular arm 80 or 82. This is illustrated in FIG. 4 by the dotted lines illustrating a phantom purlin 6' with a purlin top horizontal flange 8' in an opposite orientation with respect to purlin 6. In order to equip dispenser 200 for use on phantom purlin 6', biasing mechanism 40 need only be removed from arm 80 at position A and assembled through arm 82 at position B. Therefore, the contractor always has the unique ability with the subject invention to choose which direction or end of the building (or which wall) to start dispensing from.

Roll fabric engagement member 60 comprises an elongated and generally arcuate metal sheet which is welded or mechanically fastened (or otherwise fixedly attached) to frame member 14. As stated above, the shape of member 60 should be such that it can accommodate a variety of roll sizes yet will continue to embrace a roll of fabric 90 and allow it to rotate therein as the roll size decreases during dispensing (without coming into interfering contact with purlins 6).

Guide member 16 of dispenser 200 may take several forms. In one embodiment (FIG. 4), guide member 16 includes a substantially flat central plate 18 fixedly mounted to frame member 14 with side flanges 20 extending downwardly from each side thereby to better guide dispenser 200 along purlin 6. Guide member 16 may include a forward extending roller 24 retained by plate 22, and made of a low friction surface such as nylon or teflon for contact with purlins 6. In this embodiment, frame member 14 is bolted or welded to central plate 18. If bolted (FIG. 4) then the inside surface of plate 18 may be provided with a teflon pad (now shown) which accommodates the nuts in a counter sunk fashion so that guide member 16 slides freely on surface 8.

Frame member 14 is preferably designed to extend at an angle proximal the mounting location of guide member 16 in order to ensure improved or increased contact of guide member 16 with purlins 6 during operation of the device (laying of fabric). Moreover, to insure that tubes 80 and 82 are both usable, connected as they are by offsetting brackets 81 and 83 of equal offsetting lengths, frame member 14 should be located in the same plane as purlin 6 so that plate 30 is properly aligned with surface 9 of a purlin 6 regardless of which tube, 80 or 82, rod 44 with shaft 33 is inserted through.

Figure 10:
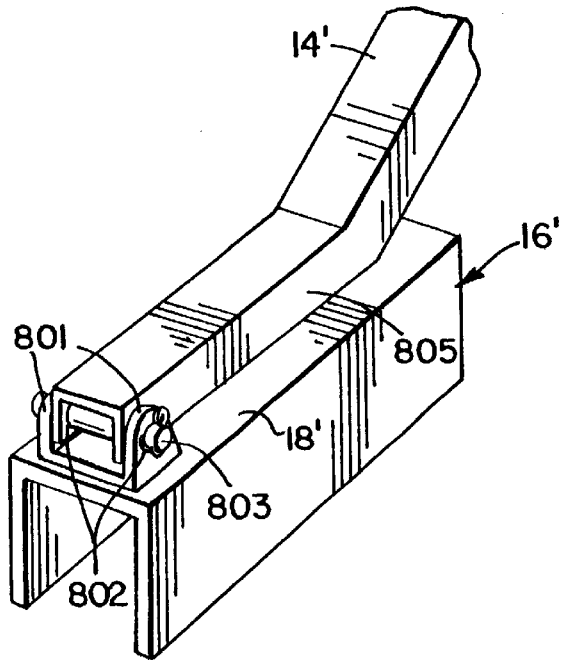
FIG. 10 is a partial perspective view of an alternative guide member according to this invention.

With reference to FIG. 10, another embodiment of the guide member of this invention is illustrated. Here no roller 24 is employed (and it is also optional in the device of FIG. 4). Moreover, the frame member, here member 14' is not bolted to guide member 16'. Rather, extending from the forward part of upper surface 18' are a pair of orificed hinge plates 801, having aligned orifices 802 therein for retaining hinge pin 803. Member 14' then has orifices (not shown) provided in its sidewalls 805 aligned with orifices 802 through which hinge pin 803 also extends. In this way member 14' is free to rotate about pin 803 as is guide member 16'. This hinge mechanism has two advantages. It assures better contact of guide 16' along the top surface of a purlin, and it eliminates the need for bolts or welds to retain member 14' on guide 16'. Of course, the inside upper surface of guide 16' can, like the same surface of guide 16, be provided with a teflon or nylon pad (not shown) to make sliding easier on a purlin.

In a typical operation on roof structure 2, glide mechanism 30 is in engagement with the under-surface of top horizontal flange 8 (or a bar joist) with guide member 16 embracing its upper surface. The loose end of fabric 90 is then unrolled and secured (e.g. by adhesive tape) to the end of the purlins at the building end from which the dispensing is to commence. Biasing mechanism 40 is then located in the appropriate tube 80 or 82, depending on which direction the flange 8 of the relevant purlin 6 extends. Via wing nut 50, the appropriate bias in coil spring 42 is effected. The entire apparatus may then be pushed forward, utilizing push pole 28, to dispense fabric as sheet 91. During this initial dispensing, wing nut may be further used to more finely adjust coil spring 42 to achieve the best operating conditions, taking into account, for example, any wind conditions that might affect dispensing.

While this invention has been described with respect to the application of fabric on a roof structure, it is not so limited. The dispensing devices of this invention may also be used to dispense fabric, for example, along a wall structure, such as a generally vertical wall of a metal building, as illustrated in one embodiment in FIG. 7.

Figure 7:
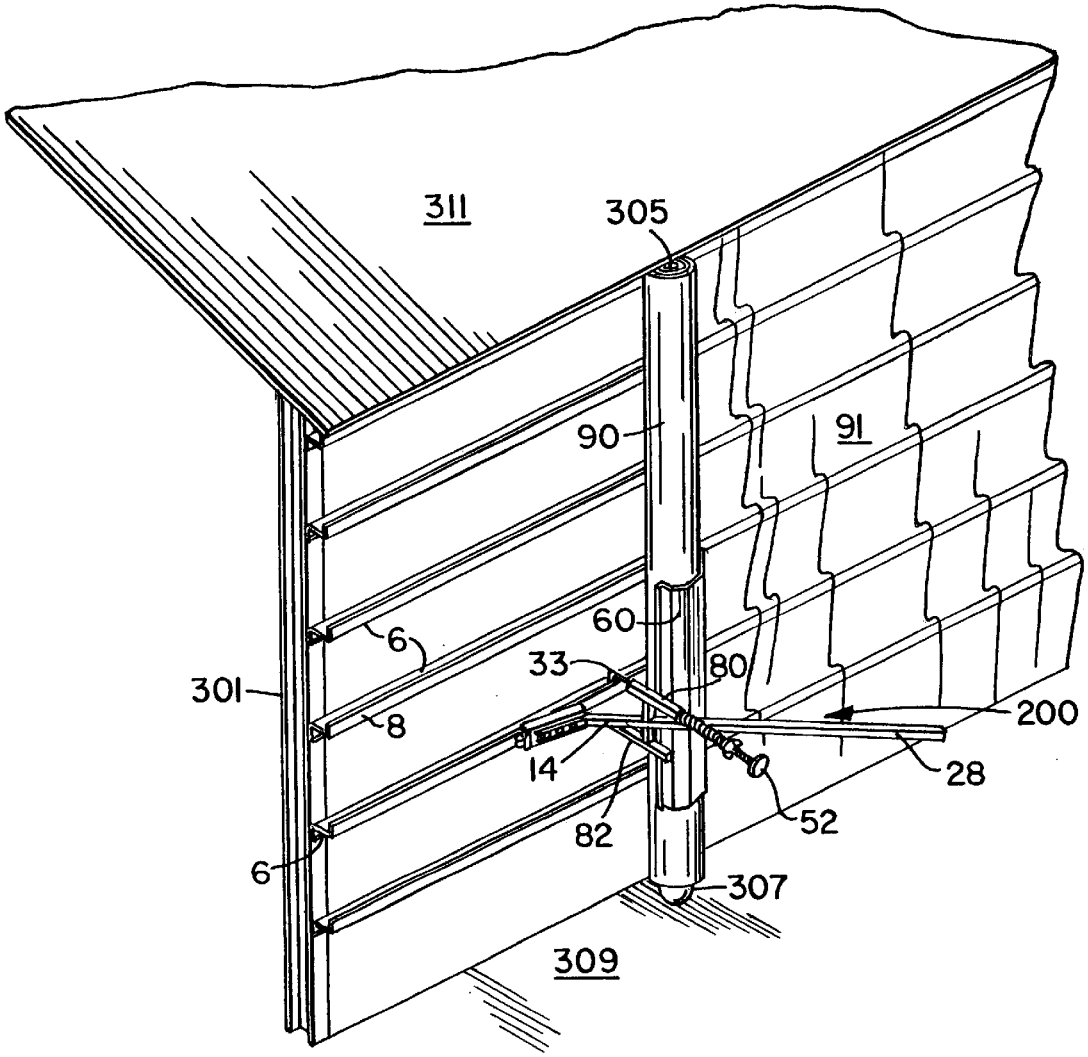
FIG. 7 is a side plan view of the device of FIG. 4 dispensing fabric across a vertical wall structure.

With reference, then, to this FIG. 7, there is illustrated a typical metal building wall structure which includes vertical wall studs 301 (only one being shown for convenience). Girts (purlins) 6 are mounted in conventional fashion on studs 301 in a generally horizontal array perpendicular to studs (also called columns) 301.

In a usual manner, the fabric on roll 90 has been rolled onto a hollow cardboard (or other material) core 305. For dispensing the fabric in sheet 91 form as illustrated, the initial roll 90 is located at one end of the wall in a vertical position. To accommodate movement, a conventional wheel, ball or similar roller means 307 having a shaft thereon inserted into hollow core 305, is provided. The first (starting) end of the fabric is attached to the first end of purlins 6 and dispenser 200 is placed on the roll and adjusted. Movement across the structure, then applies sheet 91 as illustrated. Girts 6 may, if desired, be first provided with double faced adhesive tape to hold the fabric in place. If the floor 309 on which the roller 307 resides is not smooth enough for easy rolling, a plate or board may be laid down to make rolling easier. Moreover, in the illustrated embodiment, roll 90 was designed to extend from floor (or ground) 309 the desired height to just below roof 311. In other instances scaffolding or other structures may have to be used to elevate the roll and move it horizontally to accommodate two or more horizontal sheets proximally provided, one above the other. In each instance dispenser 200 provides a simple and effective device for applying sheet 91 to a wall structure, in addition to a roof structure.

Finally, in dispensing fabric, the dispensers of this invention may be employed to form the sheets in a variety of configurations such as stretched tightly (laterally) across purlins 6 or in a draped fashion between the purlins such as is taught in my co-pending application filed simultaneously herewith and entitled ROLLED FABRIC DISPENSING METHOD, now U.S. Pat. No. 09/511,305, the disclosure of which is incorporated herein by reference.

Once given the above disclosure, many other features, modifications, and improvements will become apparent to the skilled artisan. Such other features, modifications, and improvements are therefore considered to be part of this invention, the scope of which is to be determined by the following claims:

1. A rolled fabric dispensing device for applying a sheet of fabric from a roll of fabric over a first surface of a laterally extending flange member of a longitudinally extending structural member of a building, wherein said flange member includes a second surface opposite said first surface, the rolled fabric dispensing device comprising a frame member having attached thereto:

a) a handle for moving said device along said structural building member when dispensing fabric from said device;

b) a first guide member having a configuration capable of contacting said first surface of said laterally extending flange member and guiding said device along said flange member;

c) a second guide member having a configuration and being locatable so as to be capable of contacting said second surface of said flange member and guiding said device along said flange member when said first guide member is in contact with said first surface;

d) a fabric retaining member for locating a roll of fabric therein in a dispensing position; and e) a biasing mechanism which biases said first guide member into contact with said first surface, said second guide member into contact with said second surface and said fabric retaining member against a roll of fabric when located therein, wherein said biasing mechanism includes a biasing spring connectable at one end to said frame member and at the other end to said second guide member and means for connecting said biasing spring to said frame member and to said second guide means, said connecting means being so constructed as to allow said second guide means to be in biased contact with said second surface of said flange member when said flange member laterally extends in either the right or left lateral direction from said longitudinally extending structural member and wherein said connecting means includes two hollow tubes connected to said frame member, said frame member including a longitudinal beam member located in substantially the same plane as said longitudinally extending structural member when said guide members are biased onto their respective guiding position and wherein said hollow tubes are located with respect to said frame member so that one of said tubes is located on one side of said plane of said longitudinally extending structural member and the other said tube is located on the other side of said plane such that said second guide member is locatable on either side of said longitudinally extending frame member.

2. A rolled fabric dispensing device according to claim 1 wherein said longitudinally extending structural member includes a web portion attached to said flange member, said web portion having a structural cross member laterally connected thereto and extending therefrom and wherein said guide member comprises a glide member so constructed as to be of a size and profile which allows said glide member to guide said device along said longitudinally extending structural member without contacting said cross member.

3. In a rolled fabric dispensing device for applying a sheet of fabric from a roll of fabric across a building structure comprised of at least one pair of spaced, longitudinally extending substantially parallel structural members, at least one of said members being comprised of a first edge and a second edge separated by a web portion, said second edge of at least one of said members having connected thereto a longitudinal flange member extending laterally from said second edge, said flange comprising a first surface and a second surface to which the sheet is applied, the building structure further including at least one laterally extending cross member connected at one end to the web portion of one of the two longitudinal structural members and at the other end to the web portion of the other of the two longitudinal structural members and so located with respect to the first surface of the flange member so as to define a glide space between the cross member and the flange member;

the rolled fabric dispensing device comprising a frame member for contacting the second surface of the flange member, a rolled fabric retention member attached to the frame member for rotatably retaining the fabric roll in contact with the second surface of the flange member and a glide member attached to the frame member and engageable with the first surface of the flange member, the improvement comprising:

wherein said glide member is so constructed as to be of a size and profile which allows said glide member to be unobstructed by said cross member when said glide member is in contact with the first surface of the flange member and is moved through said glide space and said sheet of fabric is dispensed by said device and applied to said second surface of said flange member;

wherein said glide member is connected to the frame member by a mechanism which biases said glide member against the first surface of the flange member; and wherein said device includes two hollow tubes connected to said frame member, said frame member including a longitudinal beam member which is located in substantially the same plane as said longitudinal structural member which it contacts during dispensing of said fabric and wherein said two hollow tubes are located with respect to said frame member so that one of said tubes is located on one side of said plane of said longitudinal structural member and the other said tube is located on the other side of said plane such that said glide member is locatable on either side of the web portion of a said structural member having said flange member whose second surface has said sheet applied thereto.

4. A device according to claim 3 wherein said glide member includes a member selected from a glide plate or a wheeled mechanism.

5. A device according to claim 3 wherein said hollow tubes include a first and a second end and wherein said mechanism for biasing the glide member against the first surface of the flange member includes a rod movably extending through one of said hollow tubes and having a first end connected to said glide member, a coil spring having a first end and a second end, said first end of said coil spring contacting said second end of said hollow tube and said second end of said coil spring being restrained against expansion by a restraining means, wherein said rod extends through said spring, and said restraining means is so located as to restrain said spring in a compressed condition between said restraining means and said second end of said hollow tube thereby biasing said glide member against the first surface of the flange member.

6. A device according to claim 5 wherein said restraining means is adjustable to thereby adjust the amount of compression in said spring.

7. A device according to claim 5 wherein said rolled fabric retention member is so located and attached to said frame member so as to be biased by said spring to maintain said roll in contact with the second surface of the flange member.

8. A device according to claim 5 wherein said rod slidably extends through said restraining means, said coil spring and said hollow tube and said rod and said coil spring are of a sufficient size to allow said rod to be moved through said tube a sufficient distance against the bias of the coil spring to disengage said glide member from the first surface of the flange.

9. A device according to claim 8 wherein said rod and said spring are of a sufficient size to allow said rod to be moved through said tube a sufficient distance to disengage the device from the building structure.

10. A device according to claim 9 wherein said rod is threaded to receive an adjustable nut member thereon and wherein said restraining means includes a nut member adjustably threaded on said rod and so located at one end of said coil spring such that rotation of said nut on said rod causes the coil spring to expand or contract.

11. A device according to claim 3 wherein said rod, said coil spring and said nut member are removable hollow tubes, thereby to provide an adjustable biasing means and said glide member on either side of said web portion of said structural member having said flange member whose second surface has said sheet applied thereto.

12. A device according to claim 3 wherein said device includes a guide member for maintaining the alignment of said device with said second surface of said flange member and a hinge member rotatably connecting said frame member to said guide member.

13. A device according to claim 3 wherein said device includes a push pole connected to said frame member at an angle such that said push pole is substantially parallel to said structural member on which said fabric is to be dispensed.

* * * * *